US005172635A

United States Patent [19]

Theurer

[11] Patent Number: 5,172,635

[45] Date of Patent: Dec. 22, 1992

[54] TRACK WORKING MACHINE FOR THE CONTROLLED LOWERING OF A TRACK

[75] Inventor: Josef Theurer, Vienna, Austria

[73] Assignee: Franz Plasser Bahnbaumaschinen-Industriegesellschaft m.b.H., Vienna, Austria

[21] Appl. No.: 839,246

[22] Filed: Feb. 20, 1992

[30] Foreign Application Priority Data

Mar. 26, 1991 [AT] Austria ..... 662/91

[51] Int. Cl.[5] ..... E01B 27/00

[52] U.S. Cl. ..... 104/2; 104/7.2; 104/7.3; 104/12

[58] Field of Search ..... 104/2, 7.1, 7.2, 7.3, 104/12, 8, 10

[56] References Cited

U.S. PATENT DOCUMENTS

| | | | |
|---|---|---|---|
| 4,170,942 | 10/1979 | Theurer | 104/7.2 |
| 4,393,784 | 7/1983 | Thuerer | 104/2 |
| 4,643,100 | 2/1987 | Valditerra | 104/2 |
| 4,953,467 | 9/1990 | Theurer | 104/7.2 |

FOREIGN PATENT DOCUMENTS

| | | | |
|---|---|---|---|
| 1243227 | 6/1967 | Fed. Rep. of Germany . | |
| 2551781 | 3/1985 | France | 104/7.3 |

*Primary Examiner*—Mark T. Le
*Attorney, Agent, or Firm*—Kurt Kelman

[57] ABSTRACT

A track working machine for the controlled lowering of a track comprises a machine frame, at least one undercarriage supporting the machine frame on the track for mobility in an operating direction, a track stabilization unit for compacting the ballast whereby the track is lowered, the track stabilization unit being vertically adjustably mounted on the machine frame and including rail-engaging roller tools subjected to substantially horizontal vibrations extending transversely to the machine frame and the track, and a broom vertically adjustably mounted on the machine frame ahead of the track stabilization unit in the operating direction, the broom being rotatable about an axis extending transversely to the machine frame and the track.

8 Claims, 2 Drawing Sheets

TRACK WORKING MACHINE FOR THE CONTROLLED LOWERING OF A TRACK

BACKGROUND OF THE INVENTION

1. Field of the Invention

The present invention relates to a track working machine for the controlled lowering of a track comprised of two rails fastened to ties supported on ballast. It comprises a machine frame, at least one undercarriage supporting the machine frame on the track for mobility in an operating direction, a track stabilization unit for compacting the ballast whereby the track is lowered, the track stabilization unit being vertically adjustably mounted on the machine frame and including rail-engaging roller tools subjected to substantially horizontal vibrations extending transversely to the machine frame and the track, and a broom vertically adjustably mounted on the machine frame, the broom being rotatable about an axis extending transversely to the machine frame and the track.

2. Description of the Prior Art

U.S. Pat. No. 4,953,467 discloses a track surfacing machine of this type. It comprises two track stabilization units mounted on the machine frame in succession in the operating direction centrally between front and rear undercarriages supporting the machine frame on the track. Respective vertically adjustable front and rear ballast plows are mounted on the machine frame between a respective undercarriage and the track stabilization units. Two brooms, which are rotatable about axes extending transversely to the machine frame and the track, precede the rear ballast plow and cooperate therewith to aid in the movement of the plowed ballast. Another broom rotatable about a transverse axis is mounted on the machine frame behind the rear undercarriage to sweep any ballast moved by the ballast plow onto the ties either into an adjacent crib or onto a transversely extending conveyor band which removes such ballast to the track shoulders. The sweeping action of the rear broom causes some ballast stones to be thrown into the area where the ferrous fastening elements fastening the rails to the ties are located. These ballast stones remain lying there and may interfere with subsequent track work.

U.S. Pat. No. 4,170,942 discloses a mobile track leveling, lining and ballast packing machine for the non-stop correction of a track, which has never been in commercial use. This machine comprises an arrangement for compacting ballast in a transverse direction from the ends of the ties towards the points of intersection with the rails and towards the cribs, which arrangement includes an elongated vibratory plate extending along the tie ends at each side of the track and arranged cooperatively to compact the ballast therebetween. A ballast plow precedes this ballast compacting arrangement for moving ballast transversely inwardly from the tie ends and a broom rotatable about a transverse axis is associated with this ballast plow. A track lifting and lining unit is arranged between the plow and the ballast compacting arrangement which is designed to be used instead of the conventional tie tampers. No track stabilization is provided in this machine.

Accepted German patent application No. 1,243,227, published Jun. 29, 1967, discloses a small machine for compacting ballast. It comprises a small machine frame on which a carrier for four vibratory surface compactors is vertically adjustably mounted for alignment with the points of intersection of each track rail with successive ties to compact the ballast around these points of intersection. Another light machine frame is linked to the front end of the small machine frame in the operating direction, and this light frame carries a ballast broom rotatable about a transverse axis for sweeping ballast off the surface of the ties. Neither controlled lowering of the track nor track stabilization can be effected by this surface compactor.

SUMMARY OF THE INVENTION

It is the primary object of this invention to improve a track working machine of the first-described type by enabling it to remove ballast lying in the area of the ferrous elements fastening the rails to the ties of the track.

The above and other objects are accomplished according to the invention by mounting the broom vertically adjustably on the machine frame ahead of the track stabilization unit in the operating direction.

This surprisingly simple arrangement of the broom had to overcome the concept universally accepted by those skilled in the art to mount the broom at the rear end of the machine in the operating direction so that it may sweep the ballast at the end of the track surfacing operation and after the track has been correctly positioned, and had to conceive of the advantageous synergistic effect of combining track stabilization with a preceding ballast broom. As simple as it is, this novel broom arrangement has the advantage that ballast stones thrown by the rotating broom into the area where the rails are fastened to the ties are caused to glide into the adjacent cribs by the immediately following track stabilization, during which the track is vibrated in a substantially horizontal plane in a transverse direction. If such a machine comprises a ballast plow succeeded by a track leveling, lining and tamping machine which is followed by a track stabilizer which causes the leveled and lined track to settle in a well known manner to assume a desired level, its operation will not only produce an accurate track level which would be reached only after train traffic has passed over the track in the absence of track stabilization but the novel broom arrangement will also provide a complete removal of ballast from the areas where the rails are fastened to the ties, without in any way increasing the complexity and manufacturing cost of the machine. This contactless cleaning, in which the ballast stones are removed from these areas by vibration rather than in the usual manner by radially extending rubber hoses of a rotary broom, is particularly advantageous because the projecting ferrous fastening elements cause a very rapid wear of the broom hoses and, therefore, make them practically useless for removing the ballast stones from these areas. The combination of a track stabilization unit with a preceding broom is also advantageous because the final cleaning of the areas where the rails are fastened to the ties is effected by the track stabilizer which is normally used as the final stage in a track surfacing operation. Thus, a further deposit of ballast stones in these areas by succeeding track surfacing operations is impossible.

Track stabilization is well known and comprises subjecting the track simultaneously to a vertical load and to substantially horizontal vibrations extending in a direction transverse to the track to rub the track into the ballast and to compact the ballast so that the track is lowered to, and settles at, a controlled level. Track stabilizers comprising one or two track stabilization units arranged in succession in the operating direction are well known.

According to a preferred feature of the present invention, the broom is mounted immediately ahead of a leading one of the track stabilization units. Because the broom is very close to the track stabilization unit following it, ballast stones moved by the rotating broom into the areas where the rails are fastened to the ties are immediately moved off into the adjacent cribs by the vibrating track. In the illustrated embodiment, the track working machine further comprises a carrier frame for the broom, a power drive for vertically adjusting the broom on the carrier frame, and a parallelogram linkage vertically adjustably linking the carrier frame to the machine frame.

According to another feature of this embodiment, a power-driven conveyor band extends transversely to the machine frame and the track, the conveyor band being affixed to the carrier frame and preceding the broom in the operating direction, the broom being rotatable in a sweeping direction towards the conveyor band. This will prevent any accumulation of ballast in the areas where the rails are fastened to the ties, excess ballast being removed to the track shoulders by the transverse conveyor band while remaining ballast stones will glide off into the adjacent cribs as a result of the vibrations to which the track is subjected to by the succeeding track stabilization unit.

The track working machine further comprises a track leveling reference system for controlling the lowering of the track, the reference system comprising a front axle measuring the track level and the broom being mounted behind the measuring axle in the operating direction. The reference system further comprises tensioned reference lines extending in the direction of the track, a front portion of the reference lines extending above the broom being at a level higher than that of a rear portion of the reference lines whereby the reference lines slope downwardly in the operating direction. In this way, the reference system does not interfere with the vertical adjustment of the broom while it controls the lowering of the track.

According to another preferred feature, the machine frame has an upwardly recessed front section, the broom being mounted in the recessed front section of the machine frame. This enables the broom to be readily vertically adjusted between a lower operating position and a raised transit or rest position, without in any way weakening the machine frame.

The track working machine preferably further comprises a continuous action ballast tamping machine comprising a further machine frame supported on the track by front and rear undercarriages for mobility in the operating direction, the machine frame on which the track stabilization unit is mounted being a trailer having a front end adjacent the broom connected to the further machine frame and a rear end supported by an undercarriage, the track stabilization unit being mounted between the rear undercarriage of the further machine frame and the undercarriage supporting the rear end of the machine frame. Such a combined machine produces a track leveling and lining followed by a controlled lowering of the leveled track into a solidly settled position while, at the same time, saving one undercarriage for the machine frame carrying the track stabilization unit.

Such a track working may further comprise a third machine frame preceding the further machine frame in the operating direction and coupled thereto, and a ballast plow arrangement vertically adjustably mounted on the third machine frame. The front plow will provide sufficient ballast for the succeeding tie tamping and track stabilization operations. Thus, high-quality track positioning will be obtained in a single operating stage while the machine advances continuously along the track. The track position may be monitored by a track position measuring car trailing the machine frame on which the track stabilization unit is mounted and the monitored track level and line parameters may be used as control signals for controlling the preceding operations of the machine.

The track working machine may also be an independently operating track stabilizer comprising a front and a rear undercarriage supporting the machine frame on the track, the track stabilization unit being mounted between the undercarriages.

BRIEF DESCRIPTION OF THE DRAWING

The above and other objects, advantages and features of the invention will become more apparent from the following detailed description of two now preferred embodiments, taken in conjunction with the accompanying schematic drawing wherein.

DETAILED DESCRIPTION OF PREFERRED EMBODIMENTS

Figure 1:
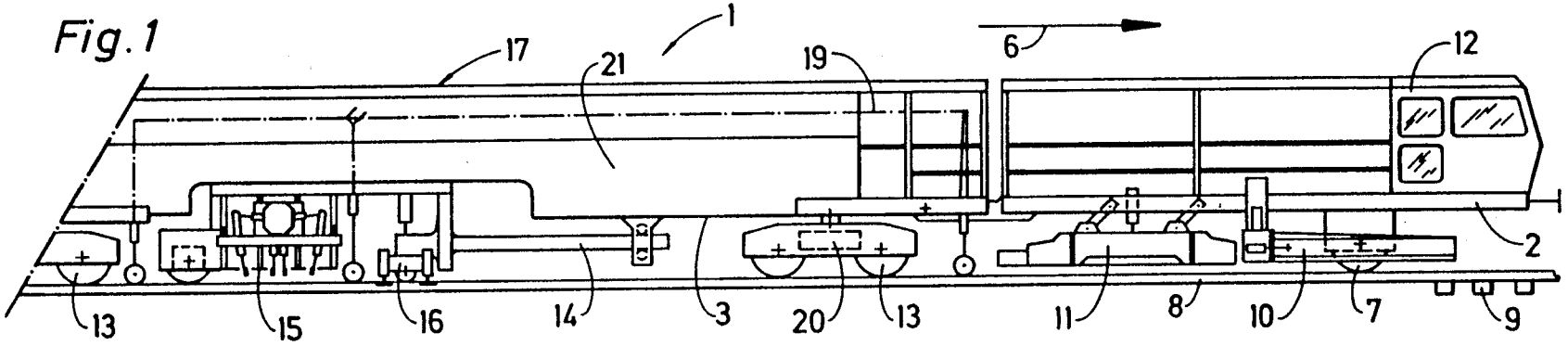
FIG. 1 is a side elevational view of the front part of a combined machine incorporating a ballast plow, a continuous action mobile track leveling, lining and tamping machine, a track stabilizer and a track position measuring car coupled to each other in succession in an operating direction, showing the ballast plow and track leveling, lining and tamping machine.
Figure 2:
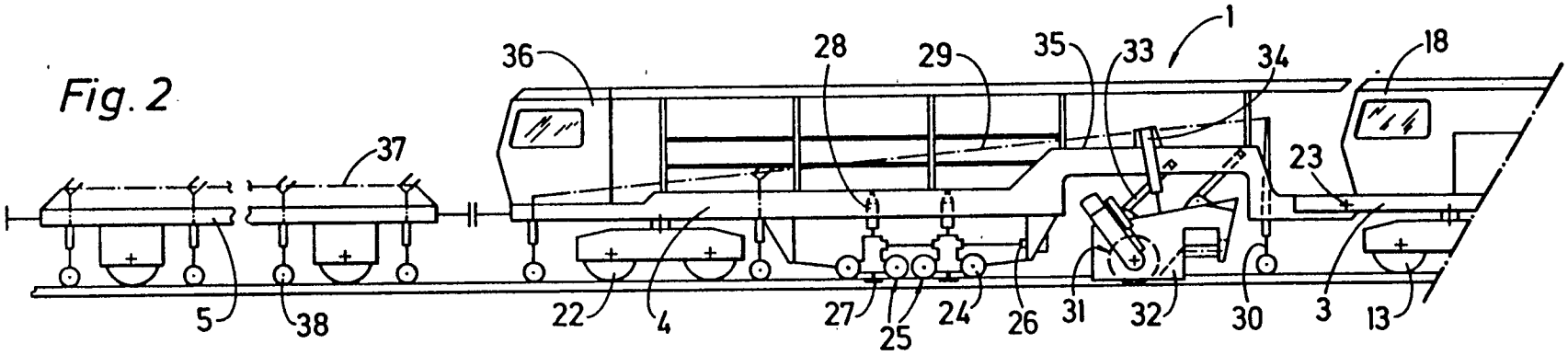
FIG. 2 is a like side elevational view showing the rear part of the combined machine, comprised of the track stabilizer and measuring car.

FIGS. 1 and 2 illustrate a combined track surfacing machine comprising four machine frames 2, 3, 4 and 5 coupled together in succession in an operating direction of the machine indicated by arrow 6. It includes a track working machine for the controlled lowering of a track comprised of two rails 8 fastened to ties 9 supported on ballast, which comprises machine frame 4, undercarriage 22 supporting the machine frame on the track for mobility in the operating direction and two track stabilization units 25, 25 arranged in succession in the operating direction for compacting the ballast whereby the track is lowered. Each track stabilization unit is vertically adjustably mounted on machine frame 4 by hydraulic drive 28 and includes rail-engaging roller tools 24, 27 subjected to substantially horizontal vibrations extending transversely to the machine frame and the track. The roller tools comprise two flanged wheels 24 whose vertical flanges engage the gage side of rails 8 and a flanged roller 27 mounted between the two flanged wheels and having a horizontally extending flange engaging the field side of the rails and subtending the rail heads, the roller tools tightly gripping the rails therebetween. Drive 26 is connected to the leading track stabilization unit 25 by a crank shaft and another crank shaft connects the trailing track stabilization unit to the leading track stabilization unit to impart to these units substantially horizontal vibrations extending transversely to machine frame 4 and the track. The structure and operation of such track stabilization units are well known and are described, for example, in U.S. Pat. No. 4,953,467.

Figure 3:
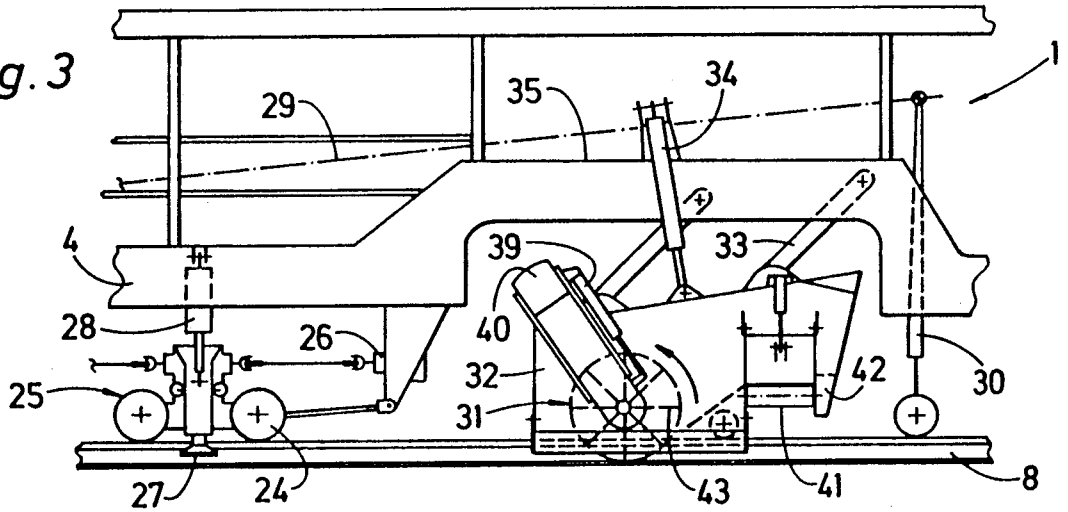
FIG. 3 is a fragmentary and enlarged side elevational view showing the broom of FIG. 2.

According to the present invention, broom 31 is vertically adjustably mounted on machine frame 4 immediately ahead of leading track stabilization unit 25 in the operating direction, the broom being rotatable about an axis extending transversely to the machine frame and the track. As best shown in FIG. 3, the track working machine further comprises carrier frame 32 for broom 31, power drive 39 for vertically adjusting the broom on the carrier frame, and parallelogram linkage 33 vertically adjustably linking carrier frame 32 to machine frame 4 by operation of drive 34 which connects the carrier frame to the machine frame. Drive 40 is connected to broom 31 for rotating the broom and conveyor band 41 driven by drive 42 extends transversely to machine frame 4 and the track, the conveyor band being affixed to carrier frame 32 and preceding broom 31 in the operating direction, the broom being rotatable counterclockwise in a sweeping direction indicated by an arcuate arrow towards the conveyor band which moves excessive ballast swept up by broom 31 to the track shoulders. The broom has radially extending sweeping elements consisting of hose sections 43.

The lowering of the track by the track stabilization units is controlled in a known manner by track leveling reference system 29 which comprises front axle 30 measuring the track level. One vertically adjustable measuring axle rolls on each rail 8 and broom 31 is mounted behind measuring axles 30 in the operating direction. As shown in FIGS. 2 and 3, reference system 29 further comprises tensioned reference lines extending in the direction of the track above the rails, a front portion of the reference lines above the broom being at a level higher than that of a rear portion of the reference lines whereby the reference lines slope upwardly in the operating direction. Machine frame 4 has an upwardly recessed front section 35 and broom 31 is vertically adjustably mounted in the recessed front section of the machine frame. Operator's cab 36 is arranged at the rear end of machine frame 4.

The illustrated track working machine further comprises continuous action ballast tamping machine 17 comprising further machine frame 3 supported on the track by front and rear undercarriages 13 for mobility in the operating direction indicated by arrow 6. Machine frame 4 on which track stabilization units 25 are mounted is a trailer having a front end adjacent broom 31 connected to further machine frame 4 and a rear end supported by undercarriage 22. The front end of machine frame 4 is linked to a rear end of further machine frame 3 at 23 and an operator's cab 18 is arranged at this rear end. The illustrated continuous action ballast tamping machine is conventional and comprises longitudinally displaceable carrier frame 14 for tamping head 15 and track lifting and lining unit 16. The carrier frame is mounted in a recessed portion of further machine frame 3 between undercarriages 13, 13 supporting further machine frame 3 on the track. The illustrated undercarriages for the ballast tamping machine are swivel trucks and the track lining and leveling is controlled by reference system 19 mounted on the ballast tamping machine. Drive 20 propels ballast tamping machine 17 along the track so that the tamping machine serves as the locomotive for combined track surfacing machine 1. Power plant 21 on tamping machine 17 supplies the energy for the various operating drives of the machine. Track stabilization units 25 are mounted between rear undercarriage 13 of further machine frame 3 and undercarriage 22 supporting the rear end of machine frame 4.

Combined machine 1 further comprises third machine frame 2 preceding further machine frame 3 in the operating direction and coupled thereto, and ballast plow arrangement is vertically adjustably mounted on the third machine frame. Third machine frame 2 also is a trailer having one end linked to further machine frame 3 while an opposite front end is supported on the track by undercarriage 7. Such ballast plows also are conventional and the illustrated plow arrangement, which is mounted on the third machine frame between undercarriage 7 and front undercarriage 13 of continuous action ballast tamping machine 17, comprises two transversely and vertically adjustable shoulder plowshares 10 immediately behind front undercarriage 7 and center plow 11. Operator's cab 12 is arranged on the front end of third machine frame 2, primarily for use during transit of machine 1 between operating sites.

Finally, machine 1 further comprises a track position measuring car trailing machine frame 4 on which the track stabilization unit is mounted. This car comprises frame 5 coupled to the rear end of machine frame 4 and equipped with track level reference arrangement 37 and various track position measuring devices 38. Such track position measuring cars are also well known.

Figure 4:
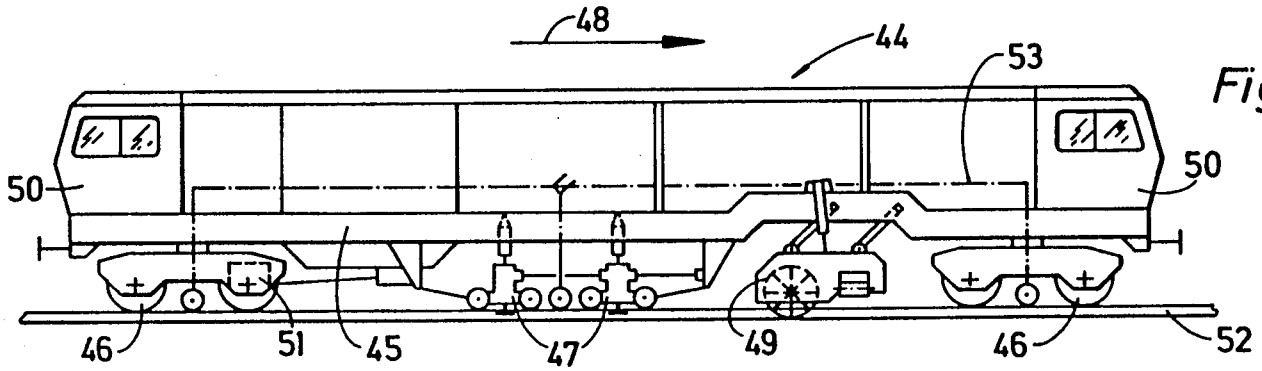
FIG. 4 is a side elevational view showing an independently operating track stabilizer according to another embodiment of this invention.

Track working machine 44 illustrated in FIG. 4 is an independently operable track stabilizer comprising front and rear undercarriages, i.e. swivel trucks, 46, 46 supporting machine frame 45 for mobility on track 52 in an operating direction indicated by arrow 48. Track stabilization units 47 are mounted between the undercarriages in the same manner as described hereinabove in connection with FIGS. 1 to 3, as is vertically adjustable broom 49. Operator's cabs 50 are arranged at each end of machine frame 45 and the machine is propelled by drive 51. Track leveling reference system 53 controls the lowering of the track by track stabilization units 47.

While track surfacing machine 1 continuously advances in the operating direction indicated by arrow 6, the plowshares of ballast plow arrangement 10, 11 are in their lowered operating position in engagement with the ballast bed to move the ballast in desired directions so as to provide a uniform ballast distribution across the ballast bed. Carrier frame 14 on continuous action ballast tamping machine 17 is cyclically longitudinally displaced on further machine frame 3 for intermittently tamping ties 9 as the machine advances continuously and as leveling and lining unit 16 levels and lines the track under control of reference system 19. Drives 34 and 39 adjust broom 31 into the illustrated operating position in which sweeping elements 43 of rotating broom 31 sweep ballast stones lying on ties 9 into the adjacent cribs or excessive ballast onto transverse conveyor band 41 which conveys this excess ballast to a track shoulder Hydraulic drives 28 and drive 26 are operated to apply downward pressure and horizontal transverse vibrations to track stabilization units 25 immediately behind broom 31 so that the track is subjected to simultaneous vertical load and transverse vibrations, these drives being under the control of track level reference system 29 to control the lowering of the track by the track stabilization units as they cause the ballast to be compacted and the track to be settled. At the same time, the vibrations of the track will cause any ballast stones remaining on ties 9 in the areas of the ferrous rail fastening elements, such as bolts or spikes, to glide off the ties into the adjacent cribs. The rear measuring car serves for an accurate control of the various track parameters, such as level, line and curvature.

What is claimed is:

1. A track working machine for controlled lowering of a track comprised of two rails fastened to ties supported on ballast, which comprises (a) a machine frame, (b) at least one undercarriage supporting the machine frame on the track for mobility in an operating direction, (c) a track stabilization unit for compacting the ballast whereby the track is lowered, the track stabilization unit being vertically adjustably mounted on the machine frame and including rail-engaging roller tools subjected to substantially horizontal vibrations extending transversely to the machine frame and the track, (d) a broom vertically adjustably mounted on the machine frame immediately ahead of the track stabilization unit in the operating direction, the broom being rotatable about an axis extending transversely to the machine frame and the track, (e) a track leveling reference system for controlling the lowering of the track, the reference system comprising a front axle measuring the track level and the broom being mounted behind the measuring axle in the operation direction, and (f) a continuous action ballast tamping machine comprising a further machine frame supported on the track by front and rear undercarriages for mobility in the operating direction, the machine frame on which the track stabilization unit is mounted being a trailer having a front end adjacent the broom connected to, and supported on, the further machine frame and a rear end supported by an undercarriage, the track stabilization unit being mounted between the rear undercarriage of the further machine frame and the undercarriage supporting the rear end of the machine frame.

2. The track working machine of claim 1, comprising two of said track stabilization units arranged in succession in the operating direction, the broom being mounted immediately ahead of a leading one of the track stabilization units.

3. The track working machine of claim 1, further comprising a carrier frame for the broom, a power drive for vertically adjusting the broom on the carrier frame, and a parallelogram linkage vertically adjustably linking the carrier frame to the machine frame.

4. The track working machine of claim 3, further comprising a power-driven conveyor band extending transversely to the machine frame and the track, the conveyor band being affixed to the carrier frame and preceding the broom in the operating direction, the broom being rotatable in a sweeping direction towards the conveyor band.

5. The track working machine of claim 1, wherein the reference system further comprises tensioned reference lines extending in the direction of the track, a front portion of the reference lines extending above the broom being at a level higher than that of a rear portion of the reference lines whereby the reference lines slope upwardly in the operating direction.

6. The track working machine of claim 1, wherein the machine frame has an upwardly recessed front section, the broom being mounted in the recessed front section of the machine frame.

7. The track working machine of claim 1, further comprising a third machine frame preceding the further machine frame in the operating direction and coupled thereto, and a ballast plow arrangement vertically adjustably mounted on the third machine frame.

8. The track working machine of claim 1, further comprising a track position measuring car trailing the machine frame on which the track stabilization unit is mounted.

* * * * *